US006265681B1

(12) United States Patent
Aromin

(10) Patent No.: US 6,265,681 B1
(45) Date of Patent: Jul. 24, 2001

(54) ROTARY ELECTRIC SWITCH

(75) Inventor: Victor V. Aromin, West Warwick, RI (US)

(73) Assignee: Tower Manufacturing Corporation, Providence, RI (US)

( * ) Notice: Subject to any disclaimer, the term of this patent is extended or adjusted under 35 U.S.C. 154(b) by 0 days.

(21) Appl. No.: 09/251,257

(22) Filed: Feb. 16, 1999

(51) Int. Cl.[7] ..... H01H 19/20
(52) U.S. Cl. ..... 200/570; 200/6 R
(58) Field of Search ..... 200/11 R–11 TN, 200/8 R, 8 A, 11 D, 11 DA, 6 R, 6 C, 6 BB

(56) References Cited

U.S. PATENT DOCUMENTS

| | | | | |
|---|---|---|---|---|
| 2,813,158 | | 11/1957 | Hutt | 200/6 |
| 4,267,460 | * | 5/1981 | Habighorst | 307/38 |
| 4,866,219 | * | 9/1989 | Riding et al. | 200/4 |
| 5,728,982 | | 3/1998 | Rao et al. | 200/6 R |
| 5,750,947 | | 5/1998 | Rao et al. | 200/6 R |

* cited by examiner

*Primary Examiner*—M. C. Sellner
*Assistant Examiner*—Nhung Nguyen
(74) *Attorney, Agent, or Firm*—Kriegsman & Kriegsman

(57) ABSTRACT

A rotary electric switch includes a hollow plastic housing having a recessed base and a cover member. A plurality of resilient stationary contacts are positioned in the recessed base. A switch handle is rotably mounted on the recessed base between the plurality of stationary contacts. A rotatable contactor assembly of considerable thickness is mounted on the switch handle. In use, rotation of the switch handle causes contact projections, which are formed on the periphery of the rotatable contactor assembly, to selectively contact the plurality of resilient stationary contacts. In one embodiment of the present invention, the rotatable contactor assembly comprises a first rotatable contactor and a second rotatable contactor which are securely affixed together. In another embodiment of the present invention, the rotatable contactor assembly comprises a first rotatable contactor, a second rotatable contactor and a thin, non-conductive washer disposed therebetween.

16 Claims, 9 Drawing Sheets

ROTARY ELECTRIC SWITCH

BACKGROUND OF THE INVENTION

The present invention relates generally to electric switches and, more particularly, to rotary electric switches.

Rotary electric switches are well-known in the art and are widely used to control alternating current circuits for a variety of applications. For example, rotary electric switches are particularly useful in connection with multispeed electric motors for household appliances, such as food processors, blenders, fans and the like.

Rotary electric switches usually include a hollow housing. The housing is usually made of plastic and includes a recessed base and a cover member. A rotatable contactor is centered in the base and is controlled by a switch handle or shaft. A plurality of resilient stationary contacts are positioned edgewise in the base around the rotatable contactor for making and breaking the several circuits through the switch.

The rotatable, or movable, contactor is constructed of a conductive material, such as brass. The rotatable contactor is typically annular shaped and has a thickness in the range of approximately 0.040 inches to approximately 0.062 inches. The rotatable contactor is shaped to include a central opening which is sized to fit over an annular boss formed on the recessed base. The rotatable contactor is also shaped to include an outer periphery which includes a plurality of integrally formed contact projections which serve the purpose of making or breaking a connection with the stationary contacts to form a closed or open circuit, respectively.

Each stationary contact is generally in the shape of a Z, where the ends of the Z represent a locking tongue and a spring contact finger which are joined together by an intermediate arm. The two bends in the Z shaped stationary contact, one where the locking tongue engages the intermediate arm and the other where the intermediate arm engages the contact finger, are supported in opposite pockets in the base so that the intermediate arm will flex slightly to distribute the bending stresses exerted on both the locking tongue and the spring finger.

The locking tongue on each stationary contact provides the switch with the capability of implementing push-in wire terminals. In particular, a wire to be connected is pushed through a wire receiving opening formed in the base, the wire receiving opening being partially covered by the free end of the locking tongue of the stationary contact. Once forced through the wire receiving opening, the wire will displace the locking tongue away from the opening which enables the wire to be fed into the base. Once the wire is sufficiently pushed through the opening, the locking tongue engages the side of the wire and effectively locks the wire within the switch between the stationary contact and a sidewall of the housing. When a pulling force is exerted to remove the wire from the switch, the wire tends to carry the tongue with it so that the locking tongue is pushed harder against the wire wedging it against the side wall of the plastic housing, the force of the wedging pressure increasing in proportion to the pulling force exerted on the wire.

In U.S. Pat. No. 5,750,947 to C. P. Rao et al, there is disclosed a rotary electric switch with conductive plates. The rotary electric switch has push-in wire terminals and includes a hollow plastic housing having a recessed base and a cover, the base having a plurality of wire receiving openings. A plurality of resilient stationary contacts are positioned in the base, each resilient stationary contact being generally Z-shaped and having a locking tongue at one end, an intermediate arm, and a spring finger at the opposite end from the locking tongue. Each resilient stationary contact is positioned in the base with its locking tongue overlying a wire receiving opening in a side wall in the housing. A rotatable contactor is mounted in the base between the spring fingers of the resilient stationary contacts. A plurality of conductive plates are disposed in the base, one conductive plate associated with each resilient stationary contact, each conductive plate contacting the resilient stationary contact at a location on its intermediate arm and in addition preventing a wire inserted into the opening from touching the sidewall of the housing. The housing includes a number of projections and standoffs to provide adequate spacing between current carrying components on the switch.

Rotary electric switches of the type described above are frequently used in commerce and have a maximum rating of approximately 13 amps. However, rotary electric switches of the type described above often experience a notable drawback. Specifically, due to the relatively narrow thickness of the rotatable contact, the contact surface area of the contact projections is limited. As a consequence, it has been found that running electricity through the relatively small contact surface area of the contact projections can result in a significant mechanical wear in the stationary contact. Significant mechanical wear in the stationary contact can cause the spring finger, and in particular the contact surface area of the spring finger, to wear away.

Wearing away of the spring finger of the stationary contact can create a significant air gap, or separation, between the rotatable contact and the plurality of stationary contacts. The creation of an air gap between the rotatable contact and the plurality of stationary contacts can result in a lost electrical connection between the rotatable contact and the stationary contacts, thereby rendering the switch nonfunctional. The creation of an air gap between the rotatable contact and the plurality of stationary contacts can also result in the flow of electricity through the air gap, or arcing, which is undesirable and destructive.

SUMMARY OF THE INVENTION

It is an object of the present invention to provide a new and improved rotary electric switch.

It is another object of the present invention to provide a rotary electric switch which includes a rotatable contactor and a plurality of resilient stationary contacts positioned around the rotatable contactor.

It is yet another object of the present invention to provide a rotary electric switch as described above in which the rotatable contactor has an outer periphery which includes one or more contact projections.

It is still another object of the present invention to provide a rotary electric switch as described above in which the outer periphery of the rotatable contactor experiences reduced unit pressure at the interface with resilient stationary contacts.

It is a further object of the present invention to provide a rotary electric switch as described above in which the contact projections on the rotatable contactor make satisfactory contact with the stationary contacts.

It is another object of the present invention to provide an electric switch as described above which avoids arcing problems.

It is still another object of the present invention to provide an electric switch as described above which has a high current handling capability.

It is a yet another object of the present invention to provide an electric switch as described above which can be easily and inexpensively mass produced, which has a minimal number of parts, which is limited in size and which can be very easily used.

Accordingly, in one embodiment of the present invention, there is provided a rotary electric switch comprising a hollow housing, said hollow housing having a recessed base and a cover member, a plurality of stationary contacts seated on the recessed base, a switch handle rotably mounted on the base of said housing, said switch handle being disposed between said plurality of stationary contacts, said switch handle comprising a disc-shaped rotor having a top surface and a bottom surface, and a rotatable contactor mounted on said switch handle for selectively contacting said stationary contacts, said rotatable contactor having a thickness in the range from approximately 0.10 inches to approximately 0.12 inches.

In another embodiment of the present invention, there is provided a rotary electric switch comprising a hollow housing, said hollow housing having a recessed base and a cover member, a plurality of stationary contacts seated on the recessed base, a switch handle rotably mounted on the base of said housing, said switch handle being disposed between said plurality of stationary contacts, said switch handle comprising a disc-shaped rotor having a top surface and a bottom surface, and a rotatable contactor assembly mounted on said switch handle for selectively contacting said stationary contacts, said rotatable contactor assembly comprising, a first rotatable contactor, and a second rotatable contactor affixed to said first rotatable contactor.

In another embodiment of the present invention, there is provided a rotary electric switch comprising a hollow housing, said hollow housing having a recessed base and a cover member, a plurality of stationary contacts seated on the recessed base, a switch handle rotably mounted on the base of said housing, said switch handle being disposed between said plurality of stationary contacts, said switch handle comprising a disc-shaped rotor having a top surface and a bottom surface, and a rotatable contactor assembly mounted on said switch handle for selectively contacting said stationary contacts, said rotatable contactor assembly comprising, a first rotatable contactor, a second rotatable contactor, and a non-conductive washer disposed between said first rotatable contactor and said second rotatable contactor for preventing current from passing between said first rotatable contactor and said second rotatable contactor.

In another embodiment of the present invention, there is provided a rotary electric switch comprising a hollow housing, said hollow housing having a recessed base and a cover member, a plurality of stationary contacts seated on the recessed base, a switch handle assembly rotably mounted on the base of said housing, said switch handle assembly being disposed between said plurality of stationary contacts, said switch handle assembly comprising a rotor having a top surface and a bottom surface, a first rotatable contactor mounted on the top surface of the rotor for selectively contacting said stationary contacts, and a second rotatable contactor mounted on the bottom surface of the rotor for selectively contacting said stationary contacts.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF A PREFERRED EMBODIMENT

Figure 2:
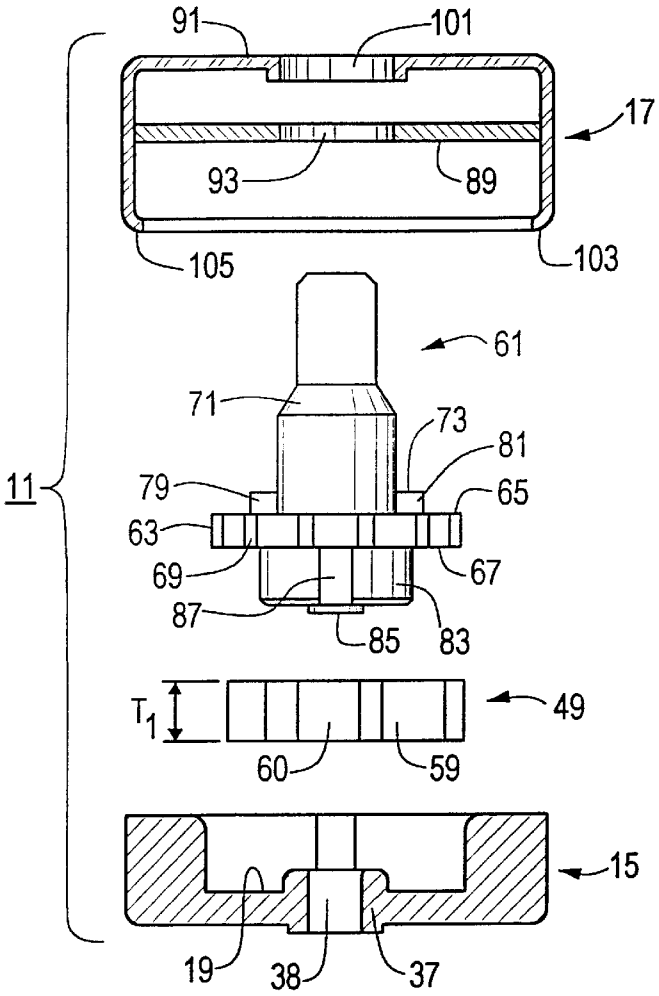
FIG. 2 is an exploded, front, sectional view of the rotary electrical switch shown in FIG. 1 taken along lines 2—2, the switch being shown without stationary contacts and shunt plates.
Figure 1:
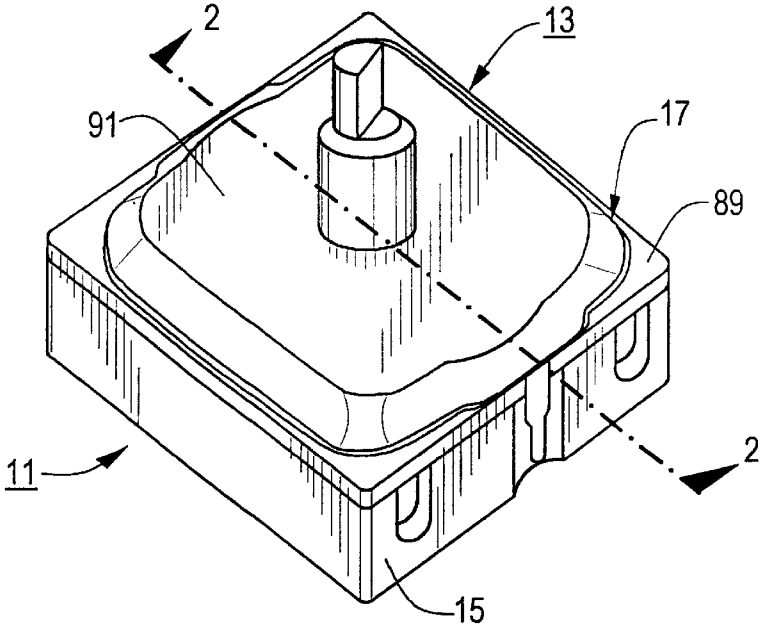
FIG. 1 is a top perspective view of a first embodiment of a rotary electric switch constructed according to the teachings of the present invention.
Figure 5:
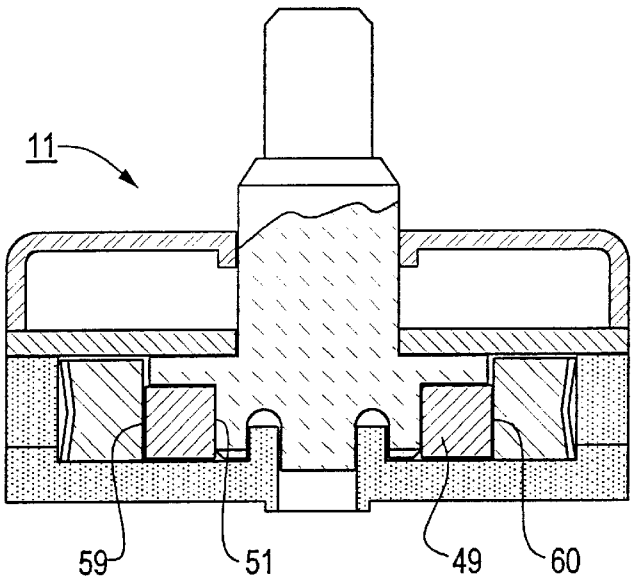
FIG. 5 is an enlarged, sectional view of the rotary electric switch shown in FIG. 3 taken along lines 5—5.
Figure 3:
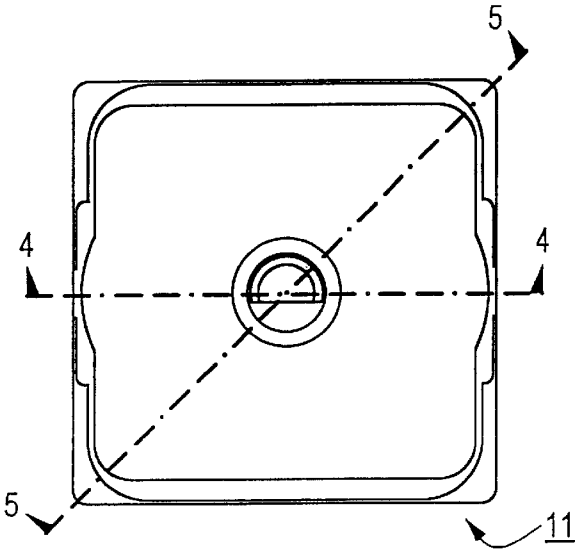
FIG. 3 is a top plan view of the rotary electric switch shown in FIG. 1.
Figure 4:
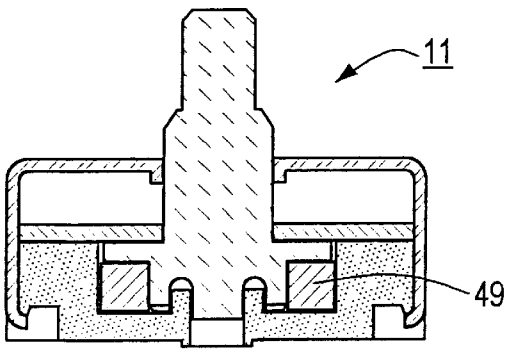
FIG. 4 is a sectional view of the rotary electric switch shown in FIG. 3 taken along lines 4—4.

Referring now to the drawings, there is shown in FIGS. 1–10 a first embodiment of a rotary electric switch constructed according to the teachings of the present invention, the rotary electric switch being represented generally by reference numeral 11. As can be appreciated, switch 11 is of the type which can be used to control alternating current circuits for such applications as the speed control of fan motors.

Switch 11 comprises a generally rectangularly shaped hollow housing 13 constructed of plastic or other suitable insulating material. Housing 13 includes a recessed base 15 and a cover member 17, recessed base 15 and cover member 17 being fixedly attached together, such as by ultrasonic welding, to make switch 11 a unitary device.

Figure 6:
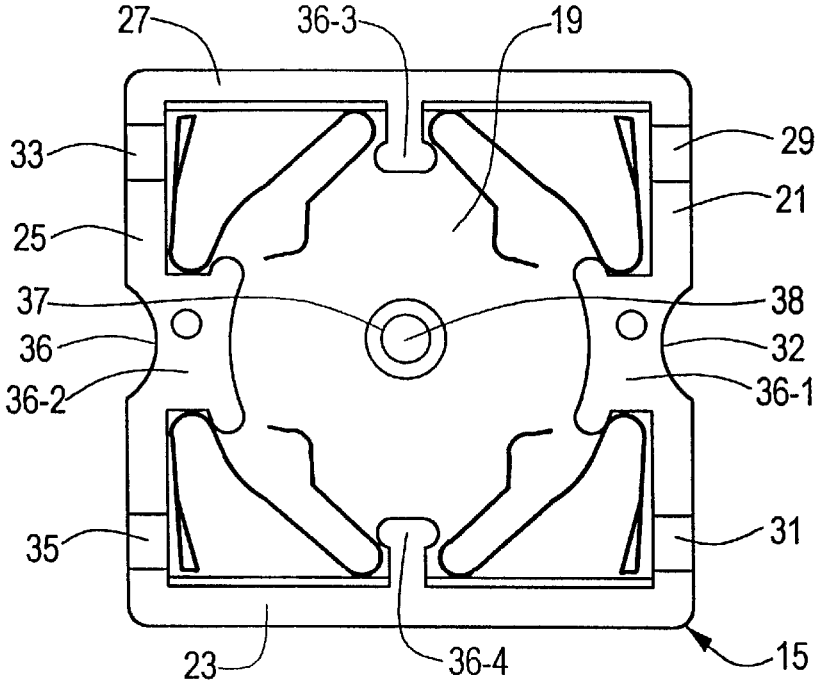
FIG. 6 is a top plan view of the base shown in FIG. 2, the base being shown with the fixed contacts and the conductive plates disposed therein.

Recessed base 15 is generally rectangularly shaped and includes a bottom wall 19 and four sidewalls 21, 23, 25 and 27, as shown in FIG. 6. Sidewall 21 includes a pair of conductor wire-receiving openings 29 and 31 and sidewall 25, which is opposite sidewall 21, includes a pair of conductor wire receiving openings 33 and 35. Sidewall 21 further includes a recess 32 formed therein between wire receiving openings 29 and 31. Sidewall 25 further includes a recess 36 formed therein between wire receiving openings 33 and 35. Base 15 further includes a pair of first partitions 36-1 and 36-2 and a pair of second partitions 36-3 and 36-4 integrally formed therein. Bottom wall 19 of base 15 includes an integrally formed annular boss 37 which is shaped to define a central bore 38 therewithin.

Figure 7:
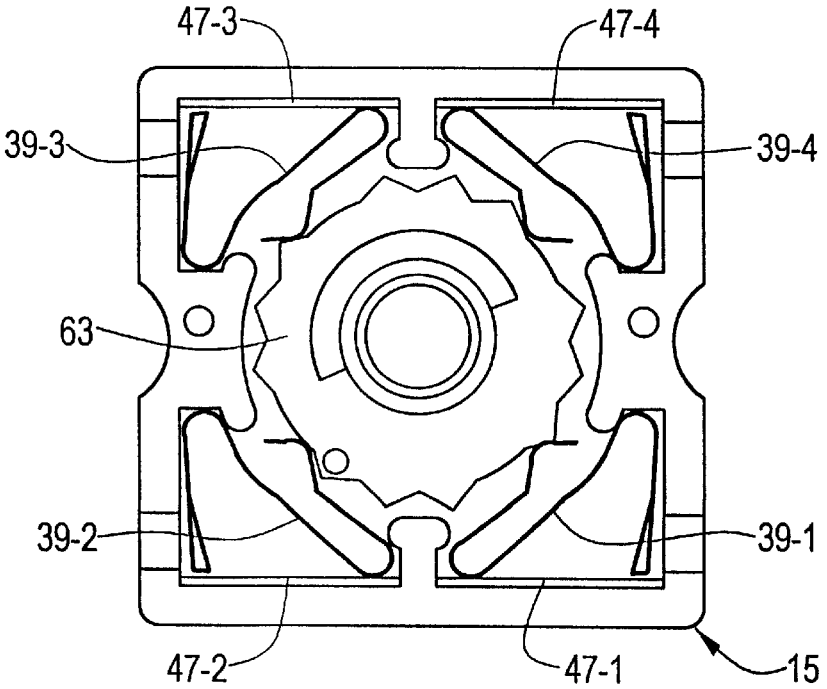
FIG. 7 is a top plan view of the rotary electric switch shown in FIG. 2, the switch being shown with the cover member removed.
Figure 8:
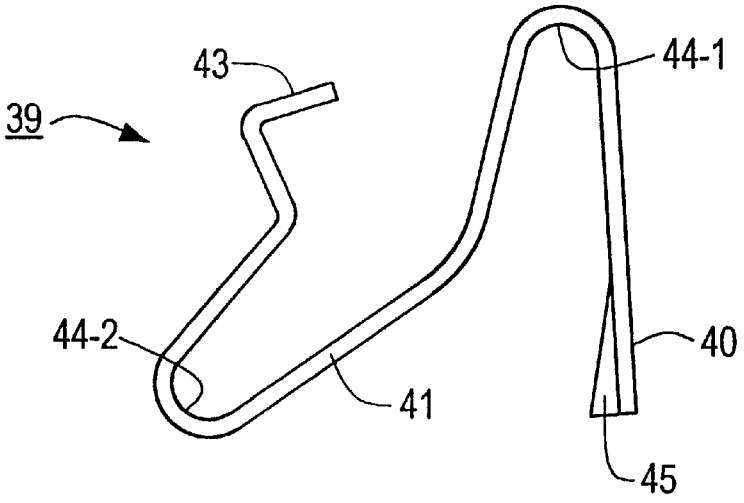
FIG. 8 is an enlarged, top plan view of one of the fixed contacts shown in FIG. 6.
Figure 9:
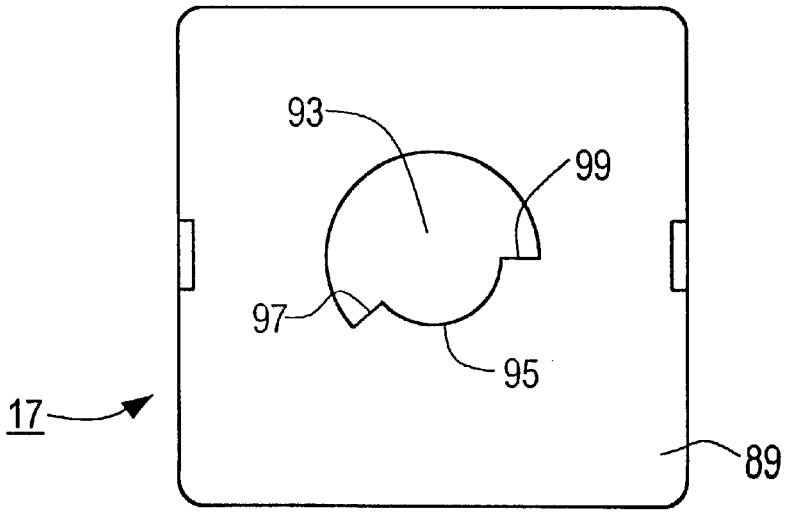
FIG. 9 is a bottom plan view of the cover member shown in FIG. 1.

Switch 11 further comprises four resilient stationary contacts 39-1 through 39-4 constructed preferably of bronze, one resilient stationary contact 39 being positioned at each corner of recessed base 15 between first partitions 36-1 and 36-2 and second partitions 36-3 and 36-4, as shown in FIGS. 6 and 7. Each resilient stationary contact 39 is generally Z-shaped and comprises a locking tongue 40 at one end, an intermediate arm 41, and a spring finger 43 at the opposite end from locking tongue 40, as shown in FIG. 8. Locking tongue 40 is joined to arm 41 at a first bend 44-1 and arm 41 is joined to finger 43 at a second bend 44-2.

Contact 39-1 is positioned in recessed base 15 between partition 36-1 and 36-4 so that the free end of its locking tongue 40 overlies conductor wire-receiving opening 31. Locking tongue 39 includes a V-shaped groove 45 at the free end thereof, groove 45 facing outwardly towards opening 31. Resilient stationary contacts 39-2 through 39-4 are positioned at the other three corners of base 15 in a similar manner.

Switch 11 further comprises four conductive plates 47-1 through 47-4 constructed preferably of brass. Conductive plate 47-1 is seated inside base 15 along sidewall 23, between sidewall 21 and partition 36-4. Plate 47-1 is positioned so as to be in contact with contact 39-1 around bend 44-2. Plates 47-2 through 47-4 are seated in base 15 in a similar manner so as to be in contact with contacts 39-2, 39-3 and 39-4, respectively.

Figure 10:
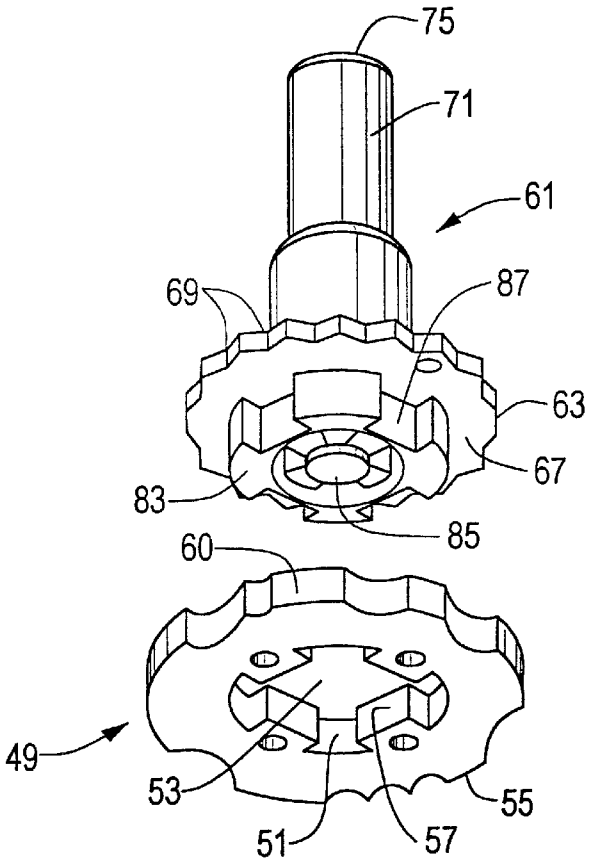
FIG. 10 is an exploded, bottom perspective view of the switch handle and rotatable contact shown in FIG. 2.

Switch 11 also comprises a rotatable contactor 49 constructed of a conductive material such as copper or brass. Rotatable contactor 49 is generally annular shaped and flat and comprises an inner wall 51 shaped to define a central opening 53 and an outer periphery 55, as shown in FIG. 10. Inner wall 51 of rotatable contactor 49 is shaped to include a plurality of engagement tabs 57 which extend inward into central opening 53. In addition, outer periphery 55 of rotatable contactor 49 is shaped to include a plurality of contact projections 59, contact projections 59 having a contact surface area 60. In use, contact surface area 60 of projections 59 serve the purpose of making or breaking a connection with spring fingers 43 of stationary contacts 39 to form an open or closed circuit, respectively.

It should be noted that rotatable contactor 49 has a thickness $T_1$ in the range from approximately 0.10 inches to approximately 0.12 inches. As can be appreciated, rotatable contactor 49 is approximately two times thicker than prior art rotatable contactors, prior art rotatable contactors typically having a thickness in the range from approximately 0.040 inches to approximately 0.062 inches. Because rotatable contactor 49 has a significantly larger thickness $T_1$ than prior art rotatable contacts, contact surface area 60 of contact projections 59 is twice the size of the contact surface area of the contact projections of most prior art contactors. The significant increase in size of contact surface area 60 of contact projections 59 makes spring finger 43 of stationary contact 39 less likely to experience a significant mechanical wear which, in turn, makes the interface between contact projections 59 of rotatable contactor 49 and spring finger 43 less likely to experience an increase in temperature during usage, which is a principal object of the present invention.

Switch 11 further comprises a one-piece switch handle 61 constructed out of a material such as plastic or nylon. Switch handle 61 comprises a generally disc-shaped rotor 63 having a top surface 65, a bottom surface 67 and a plurality of detent notches 69 formed along its periphery.

As shown in FIG. 2, switch handle 61 also comprises an elongated shaft 71 and a rotor stop 73 which are integrally formed onto top surface 65 or rotor 63. Specifically, shaft 71 is generally cylindrical in shape and comprises a free end 75. Rotor stop 73 is generally arcuate in shape and is formed on top surface 65 of rotor 63 around shaft 71. Rotor stop 73 extends approximately 150 degrees around shaft 71 and includes a first free end 79 and a second free end 81.

As shown in FIG. 10, switch handle 61 further comprises a generally disc-shaped projection 83 and a mounting post 85 which are integrally formed onto bottom surface 67 of rotor 63. Specifically, disc-shaped projection 83 protrudes out from bottom surface 67 and comprises four detent notches 87 formed along its periphery. Detent notches 87 on projection 83 are sized and shaped to engage tabs 57 of rotatable contact 49, thereby enabling rotatable contact 49 to be securely mounted on rotor 63 in abutment with bottom surface 67. Mounting post 85 is generally cylindrical in shape and is sized and shaped so as to be pivotally disposed into bore 38 formed in base 15.

Cover member 17 of housing 13 comprises an insulating plate 89 and a cover plate 91. Insulating plate 89 is constructed of a thin, rectangularly shaped, insulative material, such as phenolic, and is shaped to define a central opening 93 through which shaft 71 of switch handle 61 is disposed. Insulating plate 89 comprises an integrally formed, U-shaped projection 95 which protrudes into central opening 93, projection 95 having a first end 97 and a second end 99. In use, rotor stop 73 formed on rotor 63 is disposed within opening 93 in insulating plate 89 and travels therethrough upon rotation of switch handle 61, first end 97 and second end 99 of projection 95 limiting the range of motion of rotor stop 73 which, in turn, limits the range of motion of switch handle 71.

Cover plate 91 is positioned over insulating plate 89 and is constructed preferably of metal. Cover plate 91 comprises a central opening 101 through which shaft 71 of switch handle 61 is disposed. Cover plate 91 further comprises a pair of downwardly protruding tabs 103 and 105 which extend down into recesses 32 and 36, respectively, and are bent inward to lock cover plate 91 onto recessed base 15.

In use, wires (not shown) can be inserted into wire receiving openings 29, 31, 33 and 35 formed in recessed base 15. Pushed into recessed base 15 in this manner, the wires deflect locking tongues 40 inward. Due to the resilient construction of contacts 39, locking tongues 40 effectively wedge the wires against conductive plates 47, thereby securely coupling the wires to stationary contacts 39 (this type of switch often being referred to as a switch having push-in wire terminals). With the wires connected to switch 11, shaft 71 of switch handle 61 is rotated which, in turn, causes contact projections 59 of rotatable contactor 49 to make or break a connection with spring fingers 43 of stationary contacts 39 to form an open or closed circuit, respectively, for switch 11. Constructed in this manner, switch 11 has a maximum rating of approximately 14.5 amps, which is a relatively high current handling capability.

As noted above, the significant increase in size of contact surface area 60 of contact projections 59, as compared to prior art rotatable contactors 49, makes spring finger 43 of stationary contact 39 less likely to experience a significant mechanical wear which, in turn, makes the interface between contact projections 59 of rotatable contactor 49 and spring finger 43 less likely to experience an increase in temperature during usage, which is a principal object of the present invention.

It should also be noted that although switch 11 is a push-in wire terminal type switch, switch 11 could employ alternative types of wire receiving terminals without departing from the spirit of the present invention. Specifically, stationary contacts 39 could alternatively include a male terminal which matingly engages a female terminal, or spade, which is mounted on the free end of the wire, this type of switch often being referred to as a quick connect terminal switch in the art. Modifying switch 11 to include quick connect terminals, rather than push-in wire terminals, would result in the switch having a maximum rating of approximately 15.0 amps, which is a relatively high current handling capability.

Figure 11:
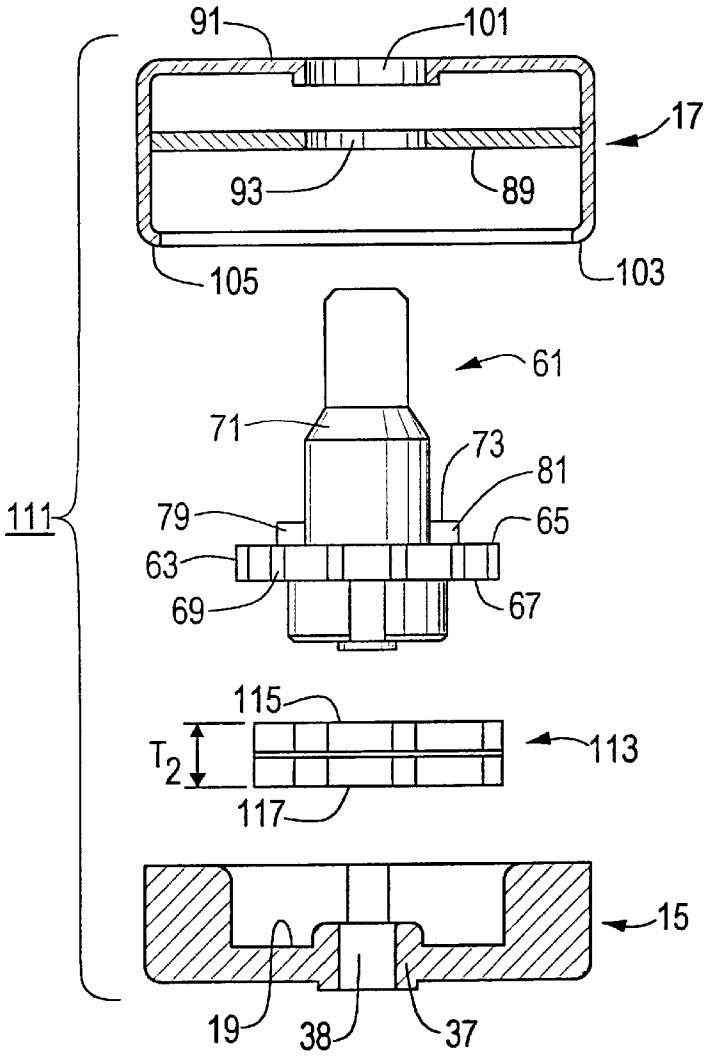
FIG. 11 is an exploded, front, sectional view of a second embodiment of a rotary electrical switch constructed according to the teachings of the present invention, the switch being shown without stationary contacts and shunt plates.
Figure 12:
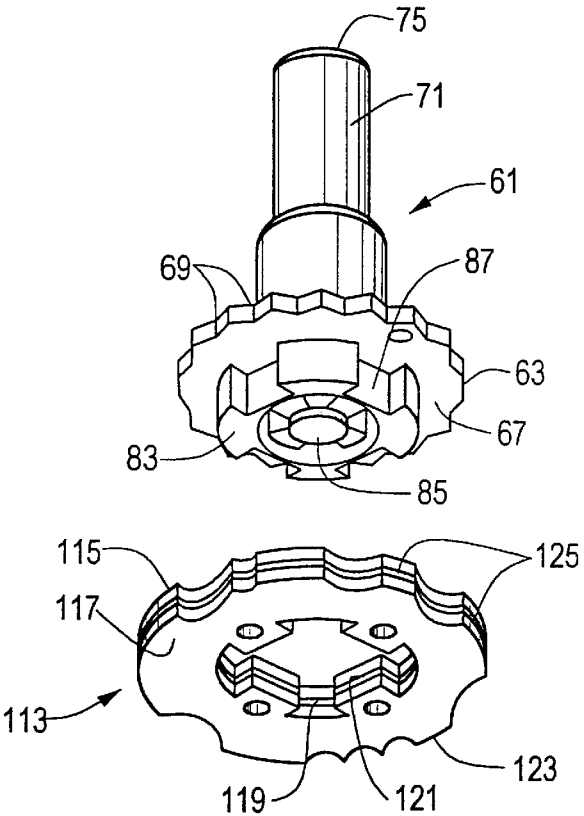
FIG. 12 is an exploded, bottom perspective view of the switch handle and rotatable contact assembly shown in FIG. 11.

Referring now to FIGS. 11–12, there is shown a second embodiment of a rotary electric switch constructed according to the teachings of the present invention, the rotary electric switch being represented generally by reference numeral 111.

Rotary electric switch 111 is identical in construction with rotary electric switch 11 except rotary electric switch 111 comprises a one-piece, rotatable contactor assembly 113 which differs in construction from rotatable contactor 49 of rotary electric switch 11. Specifically, rotatable contactor assembly 111 comprises a first rotatable contactor 115 and a second rotatable contactor 117 which are permanently affixed together. First rotatable contactor 115 and second rotatable contactor 117 are identical in size and shape and are attached together to make rotatable contactor assembly 113 a unitary device which comprises an inner wall 119 shaped to include a plurality of engagement tabs 121 and an outer periphery 123 shaped to include a plurality of contact projections 125.

First rotatable contactor 115 and second rotatable contactor 117 are permanently affixed to one another by a welding material, conductive adhesive, rivets or other suitable secure attachment means. With first rotatable contactor 115 and second rotatable contactor 117 securely affixed together, rotatable contactor assembly 113 has a thickness $T_2$ in the range from of approximately 0.08 inches to approximately 0.124 inches and functions in the same manner in which rotatable contactor 49 functions in switch 11.

It should be noted that by securely affixing together first rotatable contactor 115 and second rotatable contactor 117, there exists a limited risk of first rotatable contactor 117 moving relative to the second rotatable contactor 117. As a consequence, there exists a limited risk of air gaps being formed between first rotatable contactor 115 and second rotatable contactor 117 which, in turn, limits the risk of arcing in switch 111, which is highly undesirable.

Switch 111, which utilizes the push-in wire terminals of switch 11, has a maximum rating of approximately 14.5 amperes. However, it should be noted that modifying switch 111 to include quick connect terminals, rather than push-in wire terminals, would result in the switch having a maximum rating of approximately 15.0.

It should also be noted that switch 111 is desirable because rotatable contactor assembly 113 is easy and inexpensive to manufacture. Specifically, the particular construction of rotatable contactor assembly 113 enables for outer periphery 123, and in particular contact projections 125, to be easily manufactured to lie perpendicular to bottom wall 19 of base 15.

Figure 13:
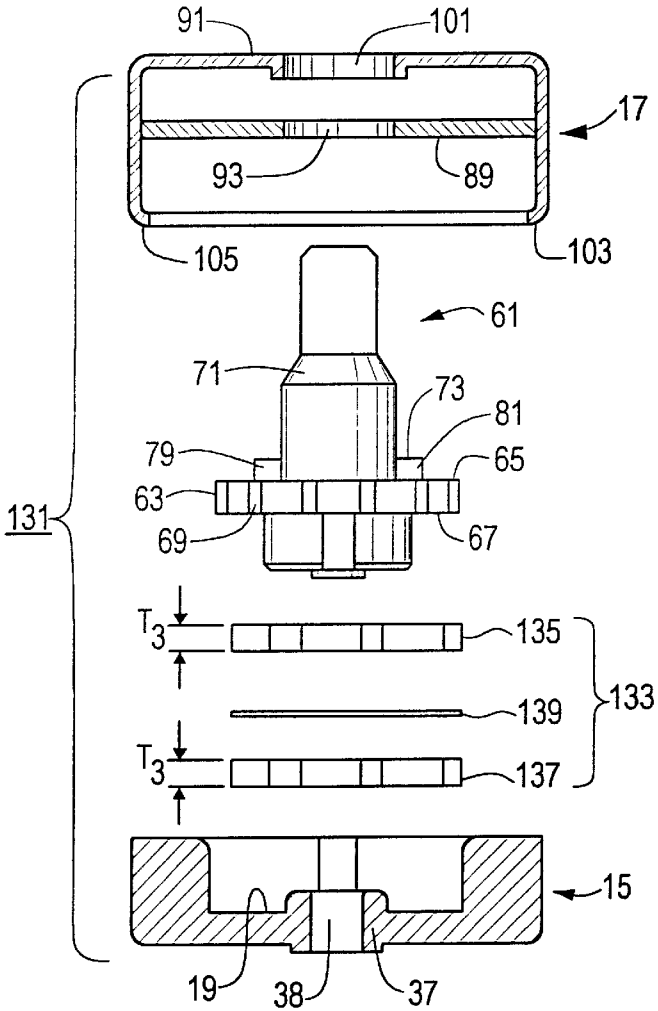
FIG. 13 is an exploded, front, sectional view of a third embodiment of a rotary electrical switch constructed according to the teachings of the present invention, the switch being shown without stationary contacts and shunt plates.
Figure 14:
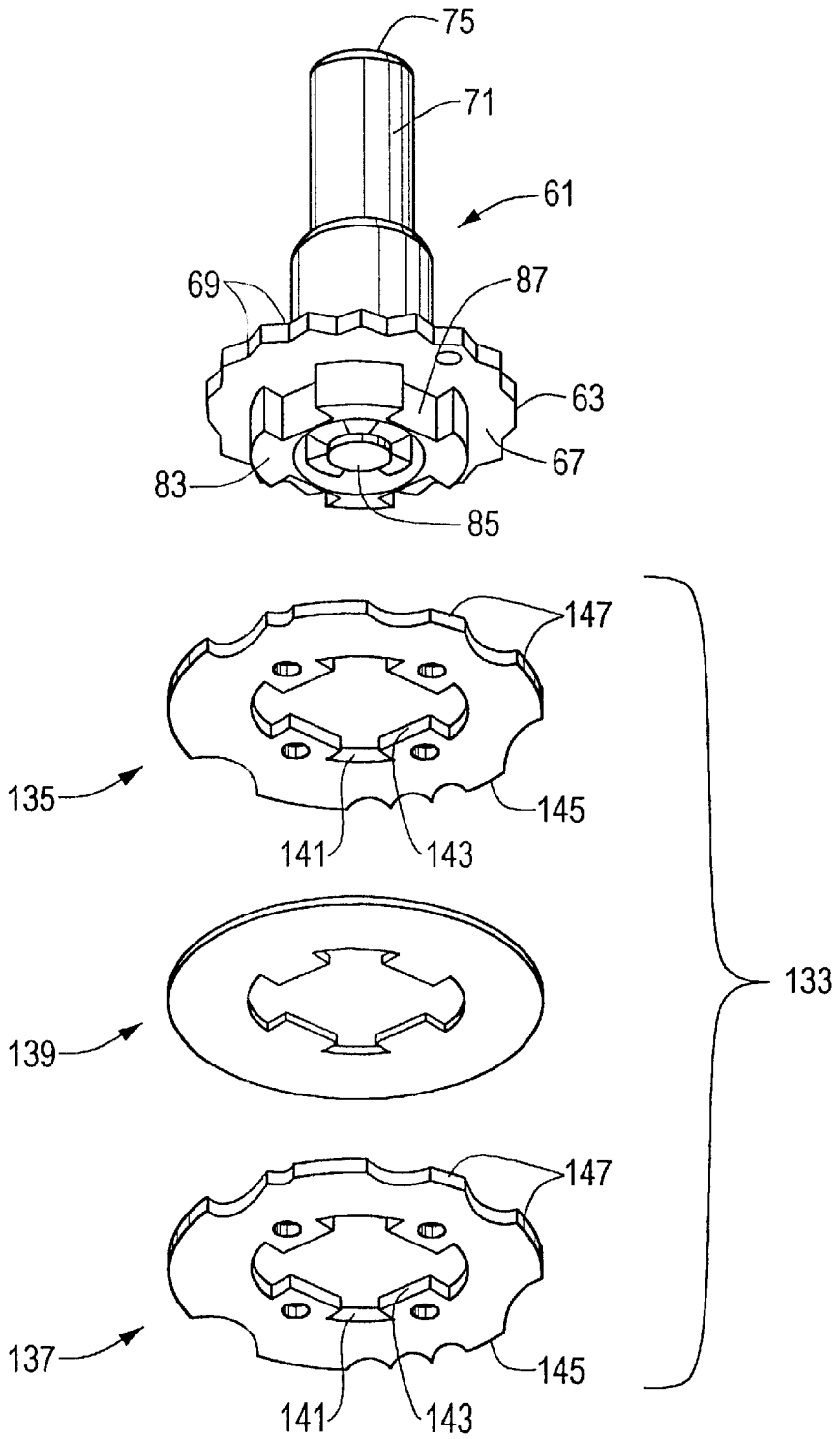
FIG. 14 is an exploded, bottom perspective view of the switch handle and rotatable contact assembly shown in FIG. 13.

Referring now to FIGS. 13–14, there is shown a third embodiment of a rotary electric switch constructed according to the teachings of the present invention, the rotary electric switch being represented generally by reference numeral 131.

Rotary electric switch 131 is identical in construction with rotary electric switch 11 except rotary electric switch 131 comprises a three-piece, rotatable contactor assembly 133 which differs in construction from rotatable contactor 49 of rotary electric switch 11. Specifically, rotatable contactor assembly 133 comprises a first rotatable contactor 135, a second rotatable contactor 137 and a thin, non-conductive washer 139 disposed between first rotatable contactor 135 and second rotatable contactor 137. Together, first rotatable contactor 135, second rotatable contactor 137 and washer 139 are securely mounted on switch handle 61 in abutment with bottom surface 67 of rotor 63.

First rotatable contactor 135 and second rotatable contactor 137 are identical in size and shape and each comprise an inner wall 141 shaped to include a plurality of engagement tabs 143 and an outer periphery 145 shaped to include a plurality of contact projections 147. First rotatable contactor 135 and second rotatable contactor 137 each have a thickness $T_3$ in the range from approximately 0.04 inches to approximately 0.062 inches.

Thin washer 139 is constructed of a non-conductive material, such as mylar, and is disposed between first rotatable contactor 135 and second rotatable contactor 137. With first rotatable contactor 135, second rotatable contactor 137 and washer 139 mounted on switch handle 61, rotatable contactor assembly 133 functions in the same manner in which rotatable contactor 49 functions in switch 11.

It should be noted that disposing non-conductive washer 139 between first rotatable contactor 135 and second rotatable contactor 137 serves to prevent current from passing between first rotatable contactor 135 and second rotatable contactor 137. As a consequence, washer 139 prevents first rotatable contactor 135 from being connected in series with second rotatable contactor 137 when there is a contact failure between any of the four stationary contacts 39 and first rotatable contactor 135 or second rotatable contactor 137.

Switch 131, which utilizes the push-in wire terminals of switch 11, has a maximum rating of approximately 14.5 amperes. However, it should be noted that modifying switch 131 to include quick connect terminals, rather than push-in wire terminals, would result in the switch having a maximum rating of approximately 15.0.

Figure 15:
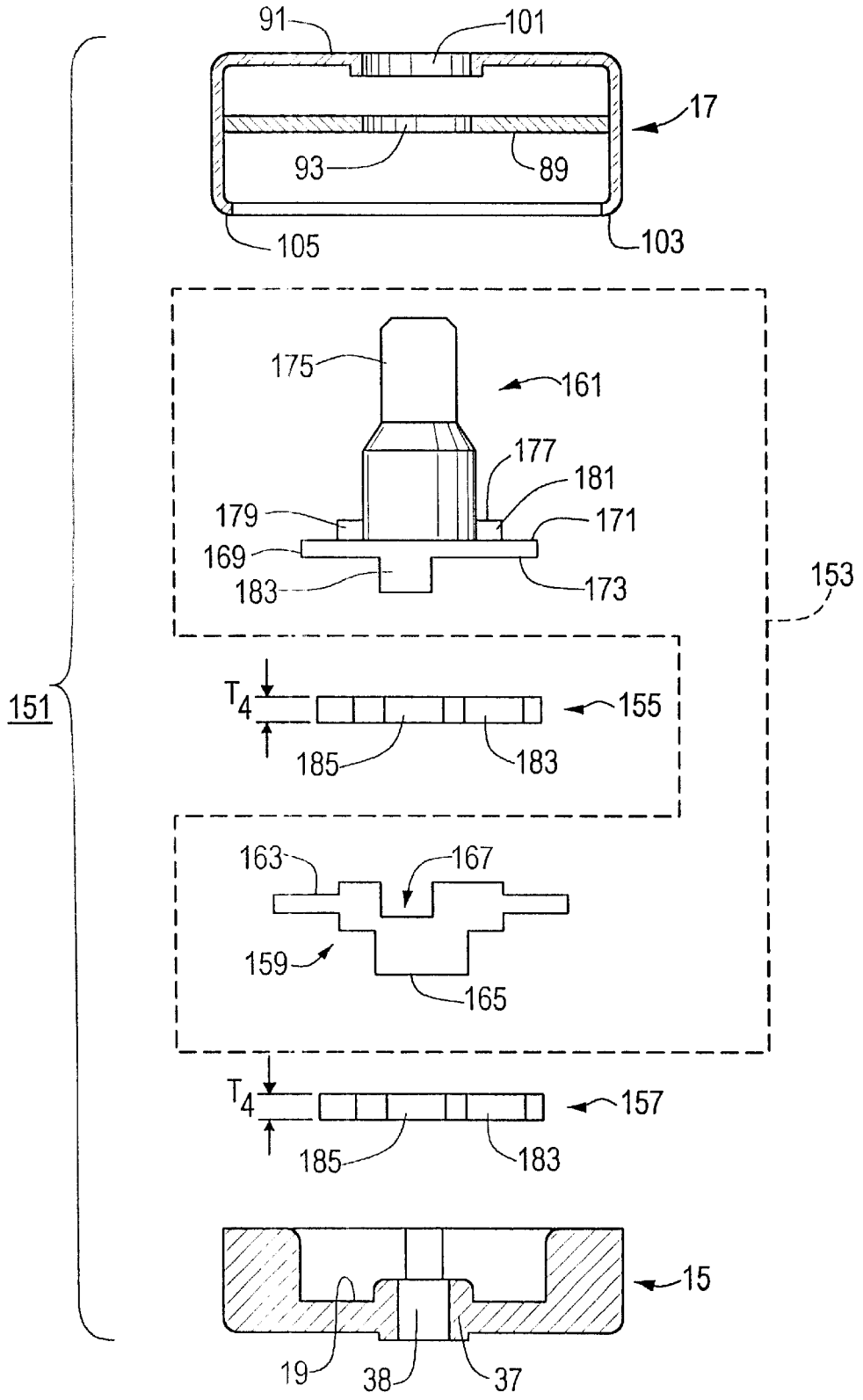
FIG. 15 is an exploded, front, sectional view of a fourth embodiment of a rotary electrical switch constructed according to the teachings of the present invention, the switch being shown without stationary contacts and shunt plates.
Figure 16:
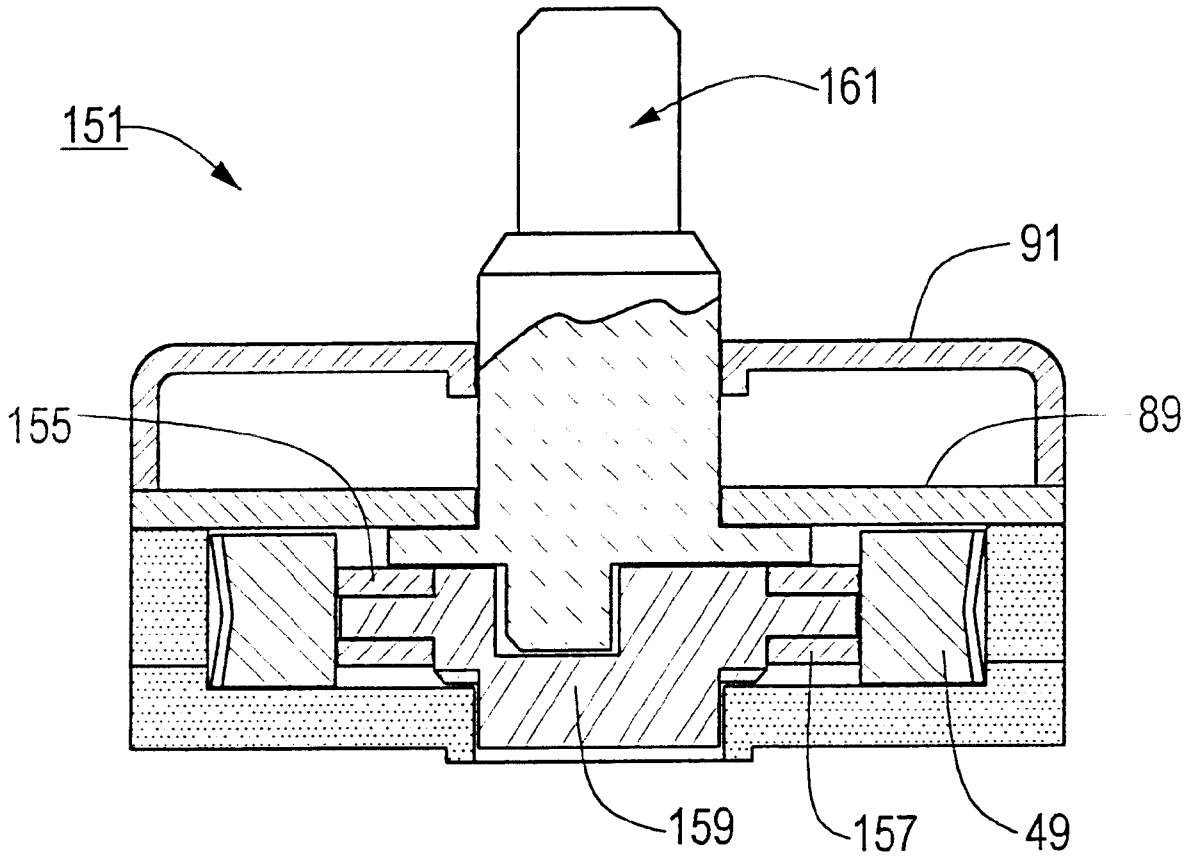
FIG. 16 is an enlarged, sectional view of the rotary electric switch shown in FIG. 15.

Referring now to FIGS. 15–16, there is shown a fourth embodiment of a rotary electric switch constructed according to the teachings of the present invention, the rotary electric switch being represented generally by reference numeral 151.

Rotary electric switch 151 is identical in construction with rotary electric switch 11 except rotary electric switch 151 comprises a two-piece switch handle assembly 153 which differs in construction from one-piece switch handle 61 of rotary electric switch 11. In addition, rotary electric switch 151 comprises a first rotatable contactor 155 and a second rotatable contactor 157 rather than the single rotatable contactor 49 of rotary electric switch 11.

Specifically, switch handle assembly 153 of switch 151 comprises a one-piece rotor 159 and a one-piece shaft assembly 161 releasably mounted on rotor 159. Rotor 159 is generally disc-shaped and comprises a top surface 163, a bottom surface 165 sized and shaped to fit over annular boss 37 in base 15 and a plurality of detent notches (not shown) formed along its periphery which engage stationary contacts 39 to temporarily lock the position of rotor 159. Top surface 163 of rotor 159 is shaped to include a keyway 167.

Shaft assembly 161 comprises a platform 169 which is annularly shaped and which comprises a top surface 171 and a bottom surface 173. An elongated shaft 175 and a rotor stop 177 are integrally formed on top surface 171 of platform 169. Rotor stop 177 is generally arcuate in shape and is formed on top surface 171 of platform 169 around shaft 175. Rotor stop 177 extends approximately 150 degrees around shaft 175 and includes a first free end 179 and a second free end 181. A mounting post 183 is integrally formed onto bottom surface 173 of platform 169 and is sized and shaped to be disposed within keyway 167 of rotor 159 to secure shaft assembly 161 onto rotor 159.

First rotatable contactor 155 and second rotatable contactor 157 are identical in size and shape and each comprise an inner wall (not shown) shaped to include a plurality of engagement tabs (not shown) and an outer periphery 183 shaped to include a plurality of contact projections 185. First rotatable contactor 155 and second rotatable contactor 157 each have a thickness $T_4$ in the range from approximately 0.04 inches to approximately 0.062 inches.

First rotatable contactor 155 is disposed between one-piece rotor 159 and one-piece shaft assembly 161. Specifically, first rotatable contactor 155 is disposed in abutment against top surface 163 of rotor 159 and in abutment against bottom surface 173 of platform 169 on shaft assembly 161. Second rotatable contactor 157 is securely mounted on rotor 159 in abutment against bottom surface 165 of rotor 159. Disposed as such, first rotatable contactor 155 and second rotatable contactor 157 function in the same manner in which rotatable contactor 49 functions in switch 11.

It should be noted that first rotatable contactor 155 and second rotatable contactor 157 are disposed on opposite sides of rotor 159. As such, rotor 159 serves to prevent current from passing between first rotatable contactor 155 and second rotatable contactor 157. Consequently, rotor 159 of switch handle assembly 153 prevents first rotatable contactor 155 from being connected in series with second rotatable contactor 157 when there is a contact failure between any of the four stationary contacts 49 and first rotatable contactor 155 or second rotatable contactor 157.

Switch 151, which utilizes the push-in wire terminals of switch 11, has a maximum rating of approximately 14.5 amperes. However, it should be noted that modifying switch 151 to include quick connect terminals, rather than push-in wire terminals, would result in the switch having a maximum rating of approximately 15.0.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A rotary electric switch comprising:

a. a hollow housing, said hollow housing having a recessed base and a cover member, b. a plurality of stationary contacts seated on the recessed base, c. a switch handle rotatable mounted on the base of said housing, said switch handle being disposed between said plurality of stationary contacts, said switch handle comprising a disc-shaped rotor having a top surface and a bottom surface, and d. a rotatable contactor mounted on said switch handle for selectively contacting said stationary contacts, said rotatable contactor having a thickness in the range from 0.10 inches to 0.12 inches.

2. The rotary electric switch as claimed in claim 1 wherein said rotatable contactor is mounted on said switch handle in contact with the bottom surface of the disc-shaped rotor.

3. The rotary electric switch as claimed in claim 2 wherein said rotatable contactor is generally annular shaped and flat and comprises an inner wall shaped to define a central opening and an outer periphery shaped to include a plurality of contact projections.

4. A rotary electric switch comprising:

a. a hollow housing, said hollow housing having a recessed base and a cover member, b. a plurality of stationary contacts seated on the recessed base, c. a switch handle rotably mounted on the base of said housing, said switch handle being disposed between said plurality of stationary contacts, said switch handle comprising a disc-shaped rotor having a top surface and a bottom surface, and d. a rotatable contactor assembly mounted on said switch handle for selectively contacting said stationary contacts, said rotatable contactor assembly comprising, i). a first rotatable contactor, and ii). a second rotatable contactor affixed to and in contact with said first rotatable contactor.

5. The rotary electric switch as claimed in claim 4 wherein said rotatable contactor assembly is mounted on said switch handle in contact with the bottom surface of the disc-shaped rotor.

6. The rotary electric switch as claimed in claim 5 wherein said rotatable contactor assembly has a thickness in the range from 0.10 inches to 0.12 inches.

7. A rotary electric switch comprising:

a. a hollow housing, said hollow housing having a recessed base and a cover member, b. a plurality of stationary contacts seated on the recessed base, c. a switch handle rotably mounted on the base of said housing, said switch handle being disposed between said plurality of stationary contacts, said switch handle comprising a disc-shaped rotor having a top surface and a bottom surface, and d. a rotatable contactor assembly mounted on said switch handle for selectively contacting said stationary contacts, said rotatable contactor assembly comprising,
   i. a first rotatable contactor,
   ii. a second rotatable contactor, and
   iii. a non-conductive washer disposed between said first rotatable contactor and said second rotatable contactor for preventing current from passing between said first rotatable contactor and said second rotatable contactor.

8. The rotary electric switch as claimed in claim 7 wherein said rotatable contactor assembly is mounted on said switch handle in contact with the bottom surface of the disc-shaped rotor.

9. The rotary electric switch as claimed in claim 8 wherein said first rotatable contactor and said second rotatable contactor each have a thickness in the range from 0.04 inches to 0.062 inches.

10. A rotary electric switch comprising:

a. a hollow housing, said hollow housing having a recessed base and a cover member, b. a plurality of stationary contacts seated on the recessed base, c. a switch handle assembly rotably mounted on the base of said housing, said switch handle assembly being disposed between said plurality of stationary contacts, said switch handle assembly comprising a rotor having a top surface and a bottom surface, d. a first rotatable contactor mounted on the top surface of the rotor for selectively contacting said stationary contacts, and e. a second rotatable contactor mounted on the bottom surface of the rotor for selectively contacting said stationary contacts.

11. The rotary electric switch as claimed in claim 10 wherein the top surface of the rotor is shaped to include a keyway.

12. The rotary electric switch as claimed in claim 11 wherein said switch handle assembly further comprises a shaft assembly releasably mounted on said rotor.

13. The rotary electric switch as claimed in claim 12 wherein said shaft assembly comprises an annularly shaped platform having a top surface and a bottom surface, an elongated shaft formed on the top surface of the platform and a mounting post formed on the bottom surface of the platform.

14. The rotary electric switch as claimed in claim 13 wherein said first rotatable contactor is disposed between the platform on said shaft assembly and the rotor.

15. The rotary electric switch as claimed in claim 14 wherein the mounting post on said shaft assembly is sized and shaped to be disposed within the keyway in the rotor to secure the shaft assembly onto the rotor.

16. The rotary electric switch as claimed in claim 15 wherein said first rotatable contactor and said second rotatable contactor each have a thickness in the range from 0.04 inches to 0.062 inches.

* * * * *